United States Patent [19]

Iwase et al.

[11] Patent Number: 4,728,208

[45] Date of Patent: Mar. 1, 1988

[54] RIBBON LIFTING MECHANISM FOR SELECTIVELY PLACING A PRINTING RIBBON AND A CORRECTION RIBBON AT A PRINTING POSITION OF A TYPEWRITER

[75] Inventors: Takayuki Iwase, Chiryu; Yuuichi Harada, Nagoyo, both of Japan

[73] Assignee: Brother Kogyo Kabushiki Kaisha, Nagoyo, Japan

[21] Appl. No.: 812,299

[22] Filed: Dec. 23, 1985

[30] Foreign Application Priority Data

Dec. 29, 1984 [JP] Japan ..... 59-277662

[51] Int. Cl.[4] ..... B41J 35/22; B41J 29/36

[52] U.S. Cl. ..... 400/697.1; 400/208; 400/212; 400/214; 400/216.1

[58] Field of Search ..... 400/194, 195, 196, 196.1, 400/207, 208, 208.1, 212, 214, 216.1, 216.4, 216.5, 225, 695, 696, 697, 697.1

[56] References Cited

U.S. PATENT DOCUMENTS

| | | | |
|---|---|---|---|
| 4,462,707 | 7/1984 | Falconieri | 400/697.1 X |
| 4,472,073 | 9/1984 | Valle et al. | 400/697.1 X |
| 4,480,931 | 11/1984 | Kamikura | 400/63 |
| 4,533,267 | 8/1985 | Kurachi et al. | 400/214 |
| 4,573,813 | 3/1986 | Aoki et al. | 400/214 |
| 4,589,788 | 5/1986 | Lendl | 400/212 X |
| 4,601,596 | 7/1986 | Musso | 400/214 X |

FOREIGN PATENT DOCUMENTS

| | | | |
|---|---|---|---|
| 38215 | 10/1981 | European Pat. Off. . | |
| 59923 | 9/1982 | European Pat. Off. . | |
| 118317 | 9/1984 | European Pat. Off. . | |
| 2362697 | 6/1975 | Fed. Rep. of Germany . | |
| 2825948 | 12/1979 | Fed. Rep. of Germany . | |
| 3208605 | 9/1983 | Fed. Rep. of Germany | 400/697 |
| 218045 | 1/1985 | Fed. Rep. of Germany . | |
| 0183279 | 10/1983 | Japan | 400/697 |
| 0012891 | 1/1984 | Japan | 400/214 |

*Primary Examiner*—Ernest T. Wright, Jr.
*Attorney, Agent, or Firm*—Lorusso & Loud

[57] ABSTRACT

A ribbon lifting mechanism usable for a typewriter including a holder turnably supported in a frame, a motor driven ribbon lifting cam and at least a cam follower operatively connected to the holder. Printing ribbon and correction tape are accommodated in the holder and either of them is located at the printing position by means of the ribbon lifting cam which is formed with a plurality of cam sections. The cam follower is actuated in accordance with cam sections on the ribbon lifting cam. The mechanism further includes a stopper member which serves to locate the printing ribbon at the printing position while it is engaged to the holder. The stopper member also serves to locate the correction tape at the printing position while it is disengaged from the holder.

13 Claims, 15 Drawing Figures

RIBBON LIFTING MECHANISM FOR SELECTIVELY PLACING A PRINTING RIBBON AND A CORRECTION RIBBON AT A PRINTING POSITION OF A TYPEWRITER

BACKGROUND OF THE INVENTION

The present invention relates to a ribbon lifting mechanism for a typewriter of the type which is so constructed that either of a printing ribbon and correction tape selectively assumes the printing position by the turning of a holder in which both the printing ribbon and correction tape are accommodated.

A typical conventional ribbon lifting mechanism of the above-mentioned type is disclosed in U.S. Pat. No. 4,533,267 and it is constituted by the combination of a holder in which a printing ribbon and correction tape are accommodated one above another, a cam member for displacing the holder up and down with the aid of a cam function, a stopper member adapted to assume the restricting position where an extent of upward displacement of the holder is restricted in order that the printing ribbon is located at the printing position during printing operation and further assume the non-restricting position where an extent of upward displacement of the holder is not restricted in order that the correction tape is located at the printing position during corrective printing operation, and an electromagnet for displacing the stopper member from the restricting position to the non-restricting position.

In the conventional ribbon lifting mechanism the holder is displaced upwardly under the effect of a cam function caused by rotation of the cam member and the printing ribbon assumes the printing position while the stopper member is located at the restricting position due to the electromagnet which fails to be activated, when normal printing operation is performed. On the other hand, when corrective printing operation is performed, the electromagnet is activated and thereby the stopper member is located at the non-restricting position, resulting in an increased extent of upward displacement of the holder. Thus, the correction tape assumes the printing position.

In order that either of the printing ribbon and correction tape selectively assumes the printing position the conventional ribbon lifting mechanism requires special driving elements such as an electromagnet and other elements which serve to displace the stopper member from the restricting position to the non-restricting position. This leads to problems in that the ribbon lifting mechanism is complicated in structure and it is manufactured at an expensive cost.

SUMMARY OF THE INVENTION

Thus, the present invention has been made with the foregoing problems in mind and its object resides in providing an improved ribbon lifting mechanism of the previously-mentioned type disclosed in U.S. Pat. No. 4,533,267 the teachings of which are incorporated herein by reference which assures that either of the printing ribbon and correction tape selectively assumes the printing position by utilizing rotational operation of a ribbon lifting cam adapted to turn the holder in which both the printing ribbon and correction tape are accommodated.

Another object of the present invention is to provide an improved ribbon lifting mechanism of the previously-mentioned type which does not require special driving elements such as an electromagnet and other elements which are employed for the conventional ribbon lifting mechanism in order that either of the printing ribbon and correction tape selectively assumes the printing position.

Another object of the present invention is to provide an improved ribbon lifting mechanism of the previously-mentioned type which is simple in structure and can be manufactured at an inexpensive cost.

To accomplish the above objects there is proposed according to the invention a ribbon lifting mechanism for a typewriter which includes a holder in which both a printing ribbon and correction tape are accommodated, the holder being turnably supported in a frame, a ribbon lifting cam adapted to be driven by a motor, the ribbon lifting cam being formed with cam sections which serve to turn the holder so as to allow either of the printing ribbon and correction tape to selectively assume the printing position, and a single cam follower operatively connected to the holder, the cam follower being actuated in accordance with the ribbon lifting cam.

In a preferred embodiment of the invention the mechanism is provided with a stopper member which serves to locate the printing ribbon at the printing position during normal printing operation while it is engaged to the holder and moreover locate the correction tape at the printing position during corrective printing operation while it is disengaged from the holder. To carry out turning movement of the stopper member the mechanism further includes means for displacing the stopper member and the means is disposed on the ribbon lifting cam.

In the present invention based on the aforementioned structure, when a normal printing operation is performed, the ribbon lifting cam is rotated in the normal direction and thereby the holder is turned upwardly with the aid of a cam function of the ribbon lifting cam. At this moment the stopper means displacing means retains the stopper means at the predetermined position while an extent of upward displacement of the stopper means is restricted. Thus, the printing ribbon is located at the printing position.

When a corrective printing operation is performed, the ribbon lifting cam is rotated in the reverse direction and thereby the stopper member is disengaged from the holder by means of the stopper member displacing means. Thereafter, the holder is displaced upwardly by rotation of the ribbon lifting cam in the normal direction and the extent of upward displacement increases without any occurrence of restriction caused by means of the stopper member. Thus, the correction tape is located at the printing position.

Other objects, features and advantages of the invention will become readily apparent from reading of the following description which has been prepared in conjunction with the accompanying drawings.

BRIEF DESCRIPTION OF THE DRAWINGS

The accompanying drawings will be briefly described below.

FIGS. 1 to 6 show a ribbon lifting mechanism in accordance with the first embodiment of the invention.

FIG. 1 is a vertical sectional side view of the mechanism as seen from the right side.

FIG. 2 is a vertical sectional side view of the mechanism as seen from the left side, particularly showing the state where the stopper member is located at the operative position.

FIG. 4(A) is a side view of the ribbon lifting cam as seen from the first cam follower side.

FIG. 5(A) is a side view of the ribbon lifting cam as seen from the second cam follower side.

FIG. 6 is a vertical sectional side view of the mechanism similar to FIG. 2, particularly showing the state where the stopper member is located at the inoperative position.

FIG. 7 is a vertical sectional side view of the mechanism as seen from the left side, particularly showing the state where the stopper member is located at the operative position.

FIG. 8 is a vertical sectional side view of the mechanism similar to FIG. 7, particularly showing the state where the stopper member is located at the inoperative position.

FIG. 9 is an enlarged fragmental view of the mechanism as seen in the direction as identified by an arrow mark X in FIG. 7, particularly showing the ribbon lifting cam and associated components.

FIG. 10 is an enlarged fragmental view of the mechanism as seen in the direction as identified by an arrow mark Y in FIG. 7, particularly showing the ribbon lifting cam and associated components.

DESCRIPTION OF THE PREFERRED EMBODIMENTS

Now, the present invention will be described in a greater detail hereunder with reference to the accompanying drawings which illustrate preferred embodiments thereof. First, description will be made as to the first embodiment of the invention with reference to FIGS. 1 to 6.

Figure 1:
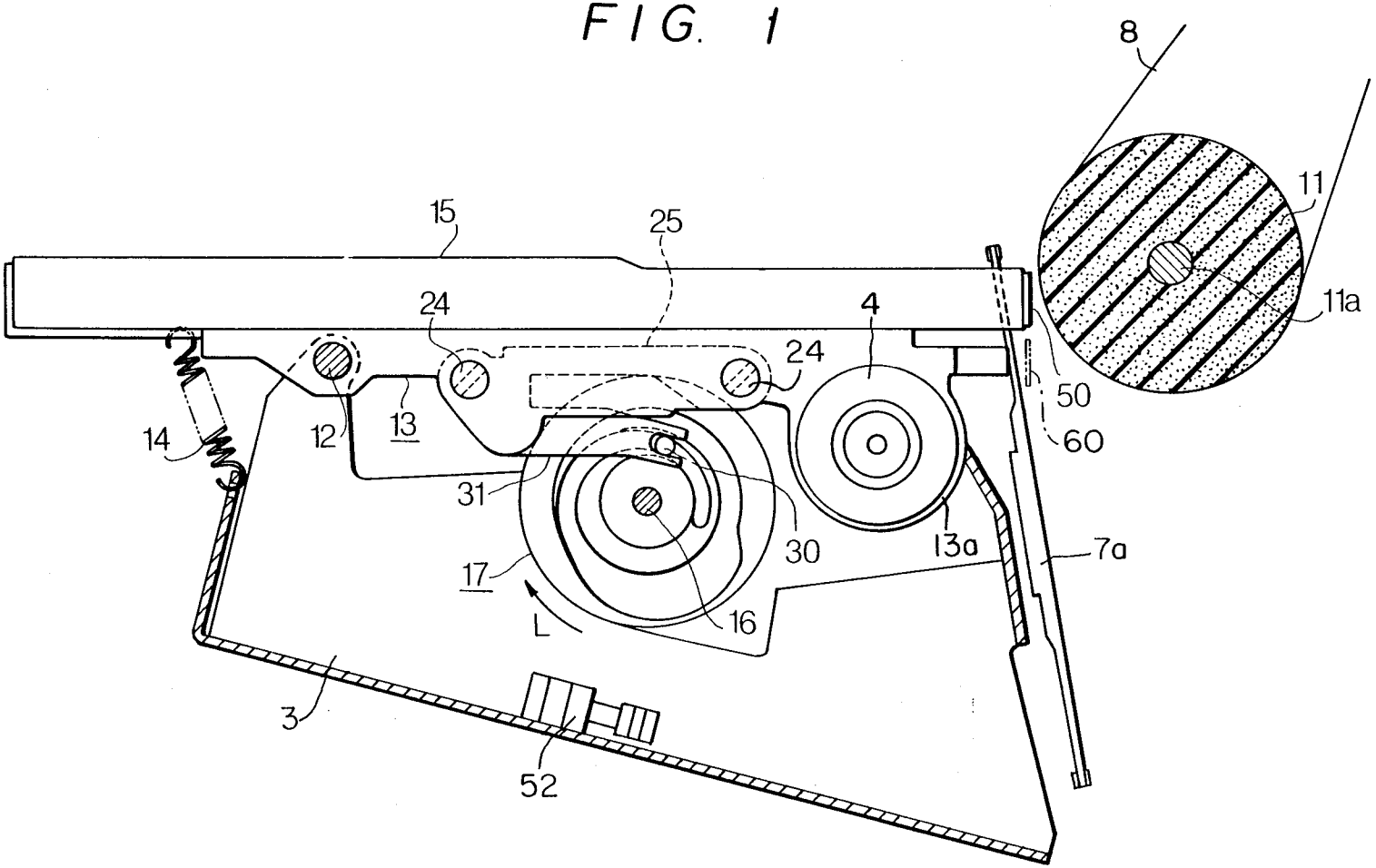
Figure 11:
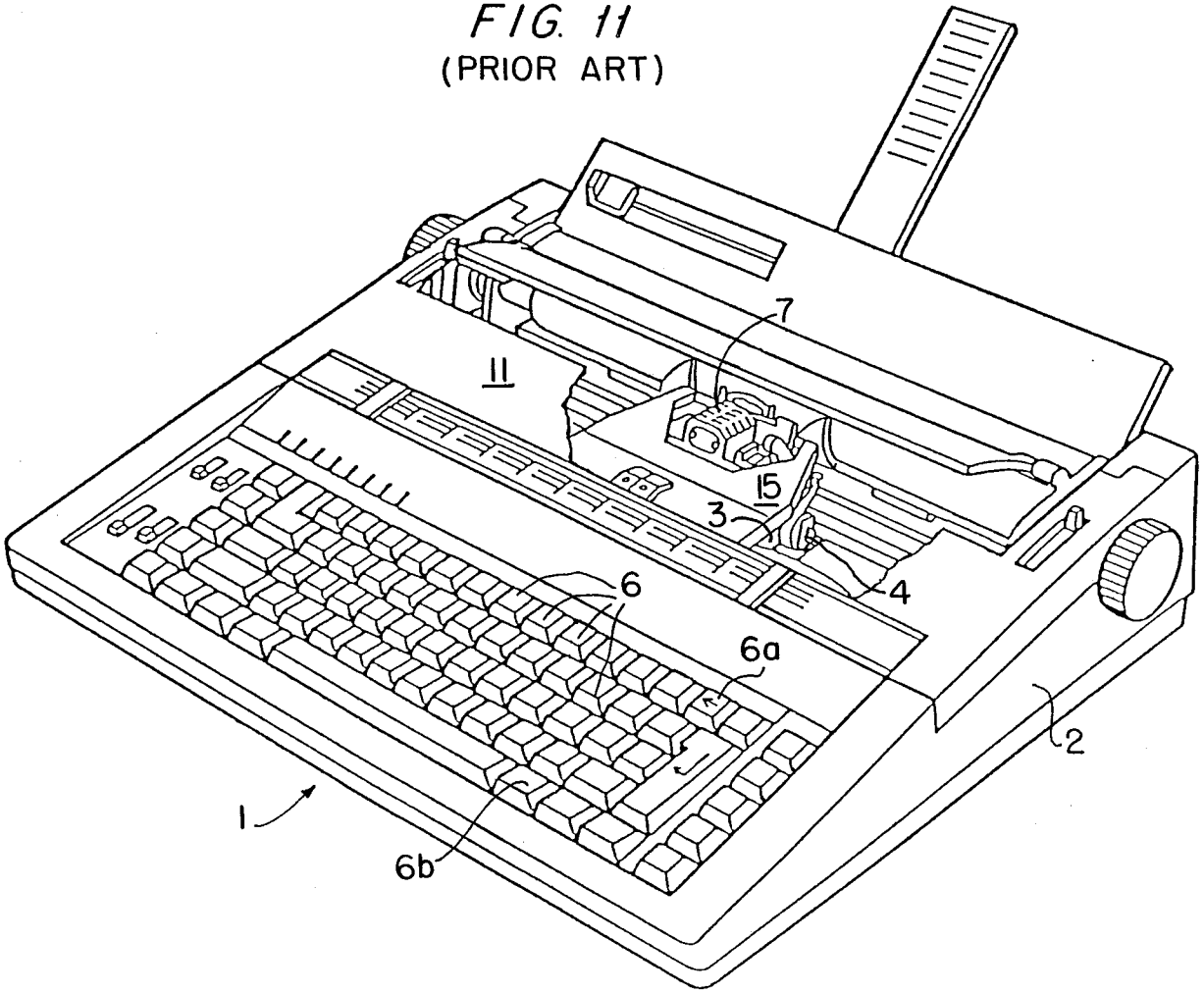
FIG. 11 (PRIOR ART)
FIG. 11 is a perspective view of a prior art typewriter which may house the mechanisms shown in FIGS. 1–10.

As shown in FIG. 11, the typewriter 1 includes a frame 2 on which a platen 11 is supported rotatably. Further, the typewriter 1 includes a carriage 3 which is movable in parallel with the rotational shaft 11*a* of the platen 11 and the carriage 3 is provided with a support shaft 12 which serves to turnably support the holder 13 thereon. As is apparent from the drawing, a tension spring 14 serving as spring means is spanned between the holder 13 and the carriage 3 so that the holder 13 is normally turned in the anticlockwise direction as seen in FIG. 1 under the effect of the resilient force of the tension spring 14. A ribbon cartridge 15 with printing ribbon 50 accommodated therein is mounted on the upper surface of the holder 13 and a part of printing ribbon 50 which is exposed from the cartridge 15 is located opposite to the fore part of the platen 11. Further, the typewriter 1 includes a correction tape 60 in the space as defined between the holder 13 and an opposing pair of downwardly projected side walls 13*a* which are made integral with the former and the correction tape 60 is spanned between a pair of spools 4 so that it is wound and unwound thereabout. Specifically, the correction tape 60 is located just below the exposed part of printing ribbon 50 and it extends in parallel with the latter.

A ribbon lifting cam 17 is designed in the form of a thick disc of which both side faces are formed with cam grooves respectively which have a contour different from one another. The ribbon lifting cam 17 is rotatably supported by means of the support shaft 16 and it is adapted to rotate in the direction as identified by an arrow mark L in FIGS. 1, 2, 4 and 5 or in the opposite direction to the foregoing one by driving a step motor 5 attached to the carriage 3 which serves as reversible driving motor.

As shown in FIG. 4(A), the ribbon lifting cam 17 is formed with a groove-shaped cam on the one side face thereof. Specifically, the groove-shaped cam comprises a first cam section 18 of which radius is designed to gradually increase as seen in the direction opposite to that as identified by an arrow mark L, the first cam section 18 serving to lift printing ribbon 50, a second cam section 19 of which radius is designed to increase as an extension from the first cam section 18, the second cam section 19 serving to lift correction tape 60, and a relieving section 20 of which radius is left unchanged and which is located opposite to the second cam section 19 to form the inside cam wall. As is apparent from the drawing, a boundary point 18*a* between the first cam section 18 and the second cam section 19 and a starting point 20*a* of the relieving section 20 are located opposite to one another and the former is located outwardly of the latter. Further, the groove-shaped cam includes an inclined section 21 as an extension from the relieving section 20 having the arched configuration of which depth is designed to decrease gradually and of which width is left unchanged and a shallow groove section 22 having the outer wall face of which radius is left unchanged. The end point of the outer wall face of the shallow groove section 22 is located in the proximity of the boundary point 18*a*.

Figure 2:
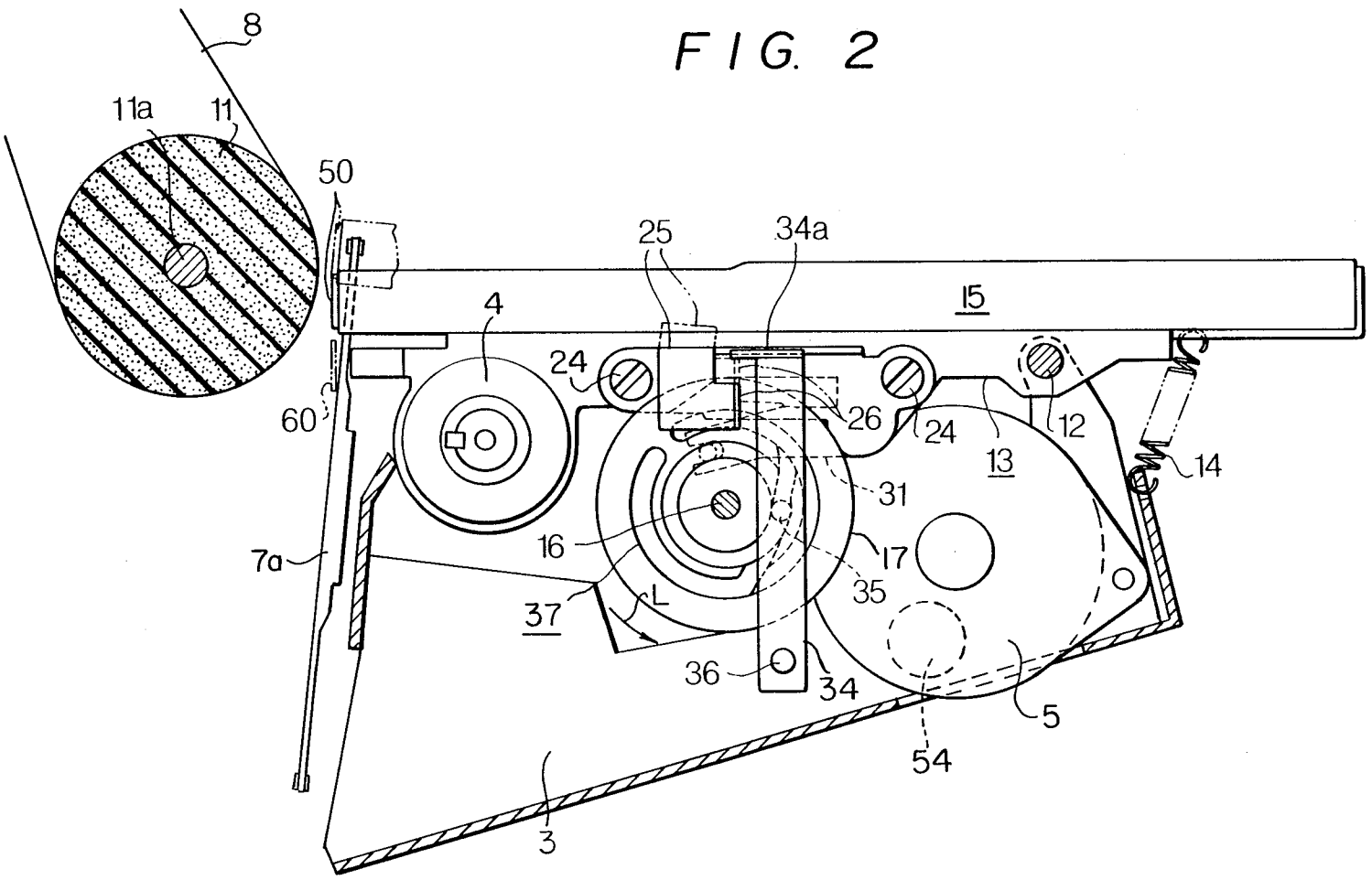
Figure 3A:
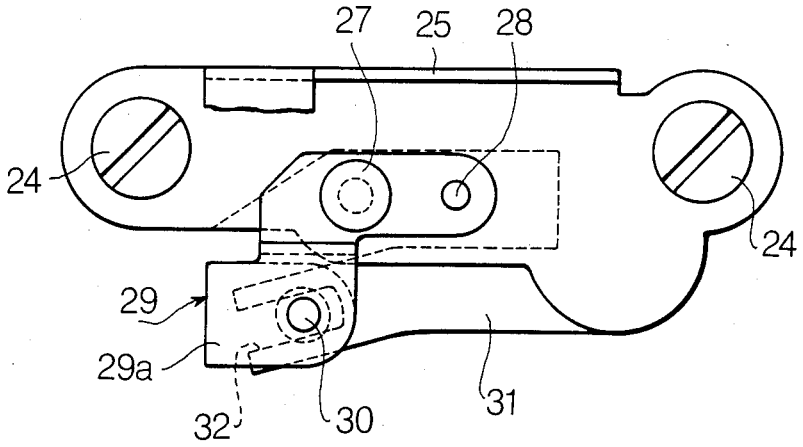
FIG. 3(A) is an enlarged side view of the engagement member as seen from the left side.
Figure 3B:
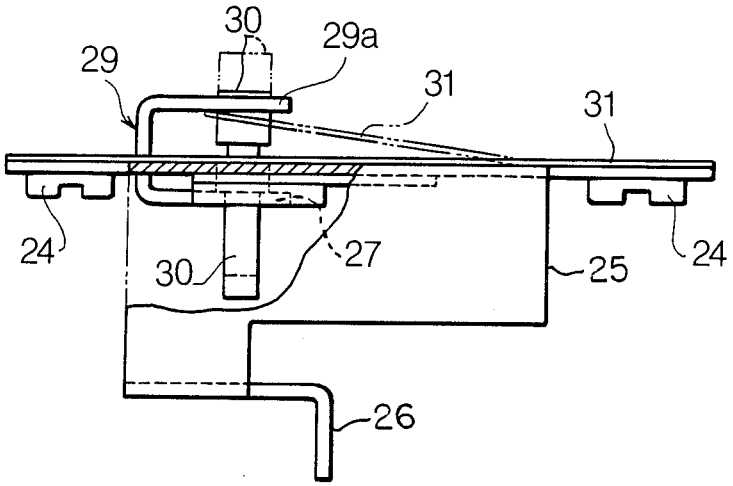
FIG. 3(B) is an enlarged plan view of the engagement member.
Figure 3C:
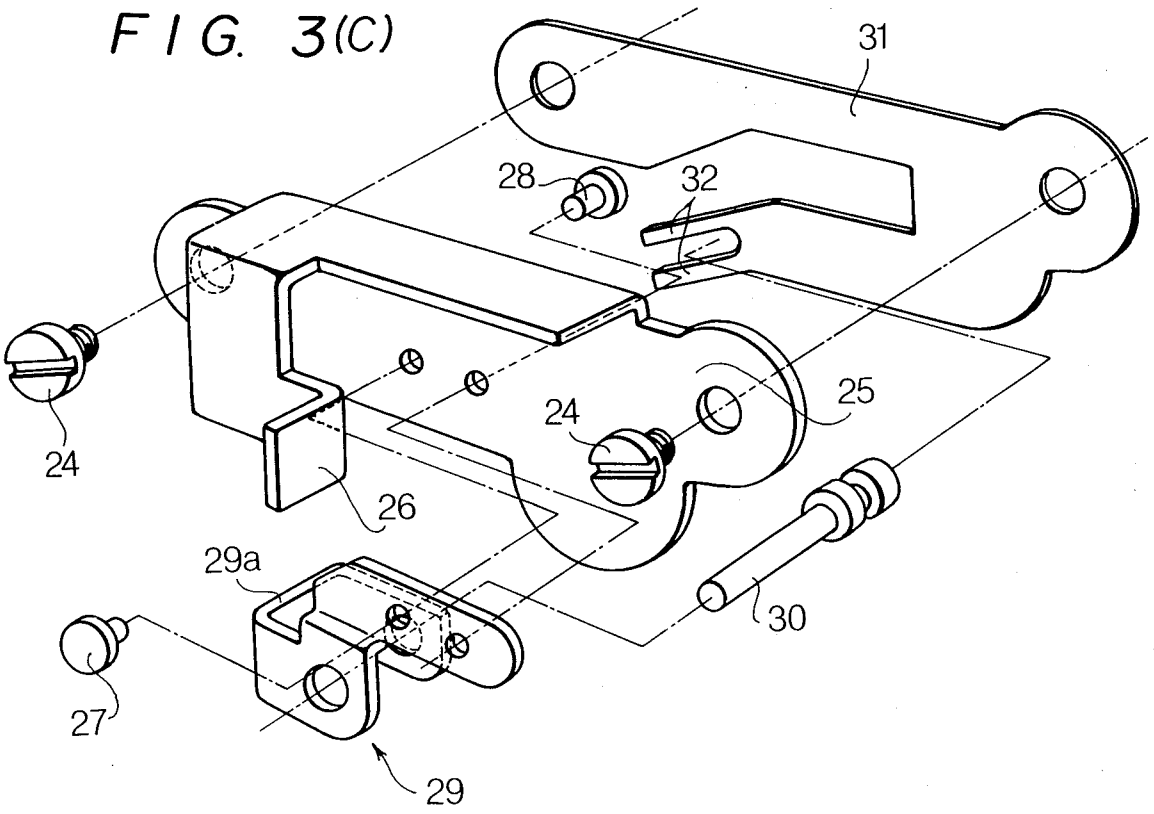
FIG. 3(C) is a perspective view of the engagement member in FIGS. 3(A) and (B) shown in the disassembled state.

As shown in FIGS. 1 and 2, the holder 13 is provided with an engagement member 25 on the one side wall 13*a* which is fixedly secured thereto by means of a pair of set screws 24. The engagement member 25 includes a engagement piece 26 which is bent outwardly therefrom, as shown in FIG. 3(B). A support piece 29 of which the fore end part is designed in the form of an U-shaped portion 29*a* is fixedly attached to the engagement member 25 in the middle area of the latter by means of a pair of pins 27 and 28. The U-shaped portion 29*a* is so designed that a pin-shaped cam follower 30 is inserted therethrough in such a manner that it moves toward the support shaft 16. A plate spring 31 is immovably held between the engagement member 25 and the holder 13 by means of the set screws 24 and a bifurcated portion 32 is formed at the free end of the plate spring 31 so that the cam follower 30 is operatively engaged thereto. As long as the cam follower 30 is operatively engaged to the bifurcated portion 32, it is forcibly urged to come in abutment against the bottom of the aforesaid sections 18 to 22 in the ribbon lifting cam 17 under the effect of the resilient force of the plate spring 31 without fail. Since the holder 13 is urged to turn about the support shaft 12 in the anticlockwise direction as seen in FIG. 1 under the effect of the resilient force of the tension spring 14, both the engagement member 25 and the plate spring 31 fixedly secured to the holder 13 are caused to turn in the same direction. As a result, the cam follower 30 is normally brought in contact with the outer wall face of the sections 18 to 22 in the ribbon lifting cam 17.

The carriage 3 is fixedly provided with a turn shaft 36 at the position located downwardly of the support shaft 16 of the ribbon lifting cam 17. As will be best seen in FIG. 2, a stopper member 34 is operatively supported to turn about the shaft 36 and the free end of the stopper member 34 is formed with a bent piece 34*a* adapted to come in engagement to the upper end of the engagement piece 26 of the engagement member 25. A second pin-shaped cam follower 35 is fixed to the stopper member 34 at the intermediate position between the turning point and the free end of the latter. It should be noted that the stopper member 34 is constructed of a plate spring and thereby the second cam follower 35 is normally urged to come in contact with the bottom of a stopper cam 37.

Figure 5:
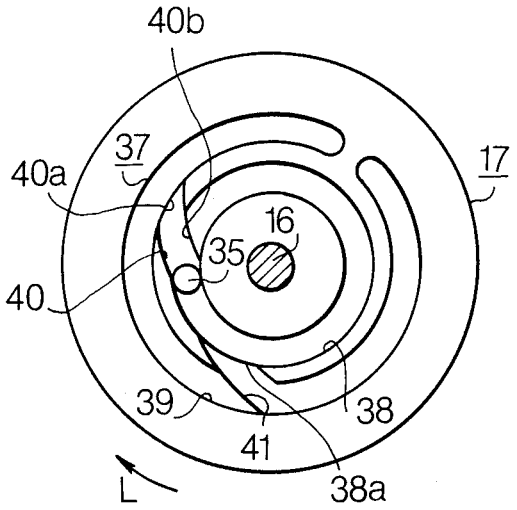
Figure 6:
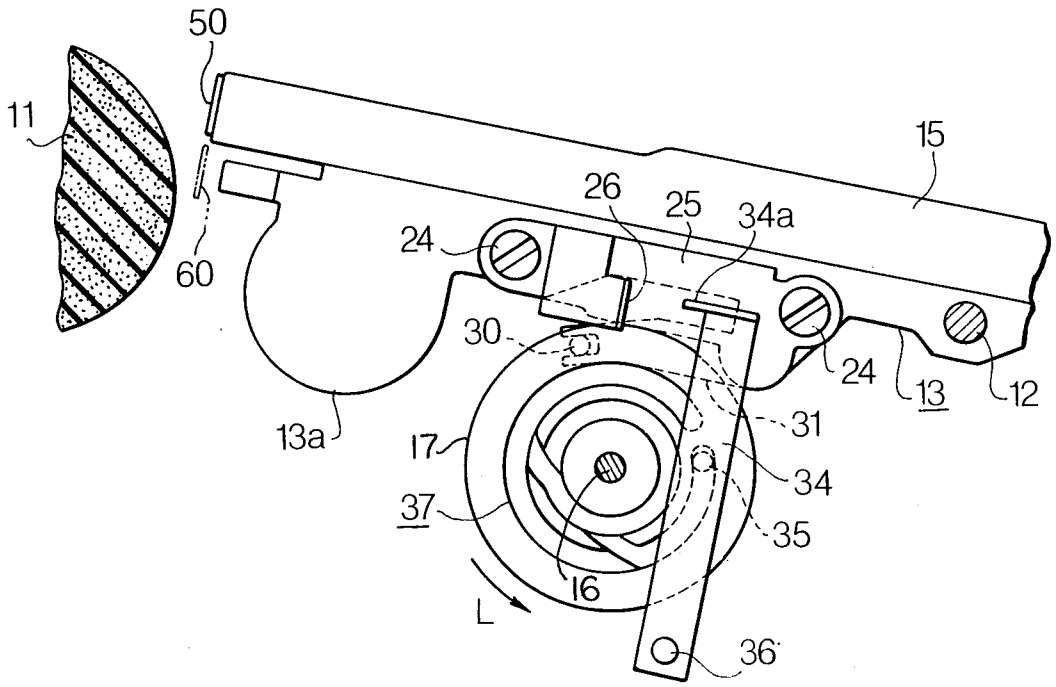

On the other hand, as shown in FIGS. 2 and 5(A), the ribbon lifting cam 17 is formed with the groove-shaped stopper cam 37 on the other side face thereof. Specifically, the stopper cam 37 essentially comprises a third cam section 38 for allowing the stopper member 34 to assume the operative position where a printing operation is carried out (as shown in FIG. 2) and a fourth cam section 39 for allowing the stopper member 34 to assume the inoperative position where a corrective printing operation is carried out (as shown in FIG. 6). As is apparent from the drawing, the fourth cam section 39 has a circular configuration of which diameter is determined larger than that of the third cam section 38. While the stopper member 34 assumes the operative position as shown in FIG. 2, the engagement piece 26 of the engagement member 25 is brought in contact with the bent piece 34*a* of the stopper member 34 during turning movement of the holder 13. On the other hand, while the stopper member 34 assumes the inoperative position as shown in FIG. 6, the engagement piece 26 of the engagement member 25 is disengaged from the bent piece 34*a* of the stopper member 34 during turning movement of the holder 13.

As shown in FIG. 5(A), the stopper cam 37 is further formed with a first introduction section 40 through which the second cam follower 35 is introduced from the third cam section 38 into the fourth cam section 39 during rotation of the ribbon lifting cam 17 in the reverse direction and a second introduction section 41 through which the second cam follower 35 is introduced from the fourth cam section 39 into the third cam section 38.

Further, the stopper cam 37 includes a first stepped section 40*a* at the boundary position where the first introduction section 40 is transferred to the fourth cam section 39. The side of the first stepped section 40*a* connected from the fourth cam section 39 is designed lower than the first introduction section side of the latter. A part of the second introduction section 41 at which the latter intersects the fourth cam section 39 at the middle part of the circular track of the latter is designed in the form of a stepped section and the part of the fourth cam section 39 located leftwardly of the second introduction section 41 as seen in FIG. 5(A) is designed higher than the part of the same located rightwardly of the second introduction section 41 as seen in the same drawing. Further, the stopper cam 37 includes a second stepped section 38*a* at the boundary position where the second introduction section 41 is transferred to the third cam section 38. The side of the second stepped section 38*a* facing to the third cam 38 is designed lower than the second introduction section 41. The inside wall 40*b* of the first introduction section 40 constitutes a stepped section which extends at a right angle relative to the third cam section 38 and the part of the third cam section 38 located upwardly of the inside wall 40*b* as seen in FIG. 5(A) is determined lower than the part of the same downwardly of the inside wall 40*b* as seen in the same drawing.

Since the second cam follower 35 is normally brought in abutment against the bottom of the cam groove of the stopper cam 37 by means of the stopper member 34 which is a plate spring, it is caused to move from the higher area to the lower area of the track of the cam groove but it does not move in the opposite direction to the foregoing one in any way. As will be described later, the second cam follower 35 is retained within the third cam section 38, as long as no corrective printing operation is performed. Once the second cam follower 35 enters the fourth cam section 39 beyond the first stepped section 40*a* via the first introduction section 40, it can not return to the third cam section 38 due to existence of the height difference as mentioned above, unless it moves via the second introduction section 41 and the second stepped section 38*a*.

Figure 4:
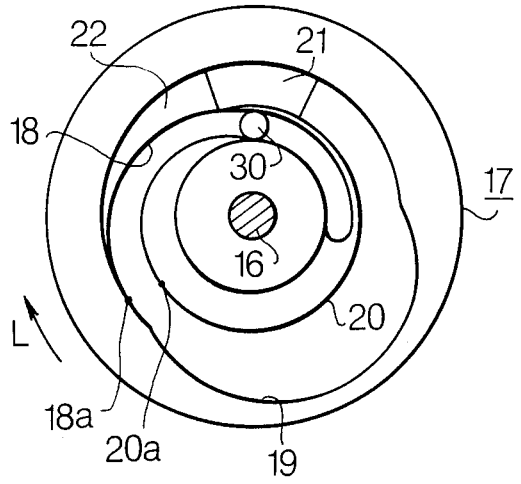

While the normal operative state is maintained, the ribbon lifting cam 17 and the first cam follower 30 assume the operative position as shown in FIGS. 1 and 4, that is, their home position. Further, while the normal operative state is maintained, the stopper cam 37 and the second cam follower 35 assume the operative position as shown in FIGS. 2 and 5, that is, their home position. Thus, when both the first cam follower 30 and the second cam follower 35 assume their home position, the holder 13 is located at the inoperative position (as represented by real lines in FIG. 1) and the stopper member 34 is located at the operative position as mentioned above.

Figure 4B:
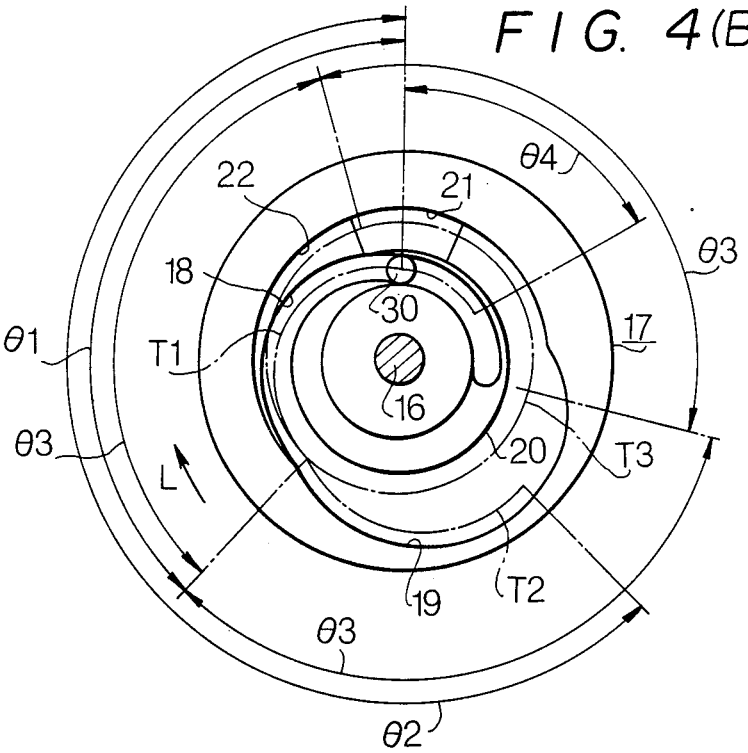
FIG. 4(B) is the same side view of the ribbon lifting cam as FIG. 4(A), particularly showing the operational relation between the ribbon lifting cam and the first cam follower.
Figure 5B:
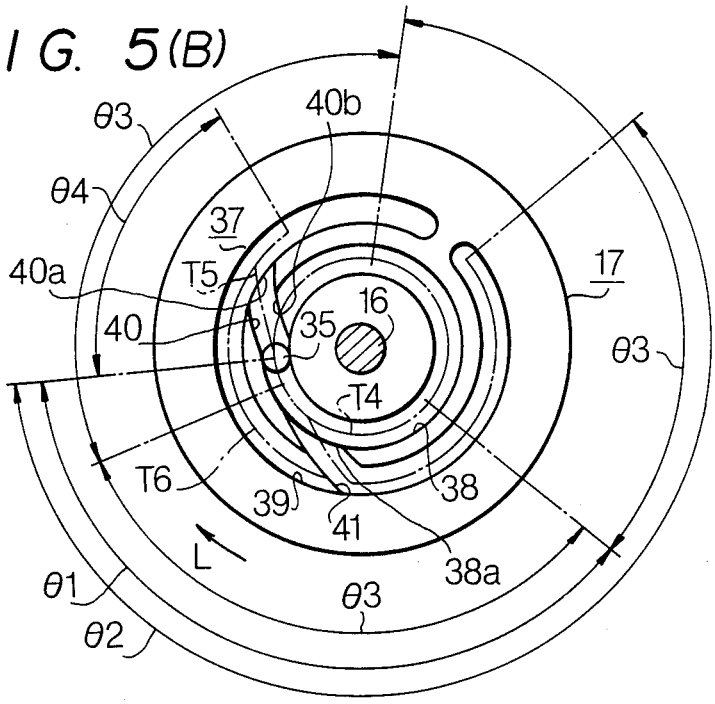
FIG. 5(B) is the same side view of the ribbon lifting cam as FIG. 5(A), particularly showing the operational relation between the ribbon lifting cam and the second cam follower.

When a printing operation is initiated by a single stroke, the ribbon lifting cam 17 is caused to rotate from the above-mentioned position by a predetermined angle of $\theta 1$ in the direction as identified by an arrow mark L in FIGS. 1 and 4(B). When the ribbon lifting cam is rotated by an angle of $\theta 1$ in that way, the first cam follower 30 carries out relative movement on the track T1 while coming in contact with the first cam section 18, as shown in FIG. 4(B). As a result, the first cam follower 30 is gradually displaced away from the support shaft 16 and the holder 13 is caused to turn in the anticlockwise direction by the resilient force of the tension spring 14 as seen in FIG. 1. On the other hand, the second cam follower 35 carries out relative movement on the track T4 along the third cam section 38, as shown in FIG. 5(B). During the relative movement, the second cam follower 35 is kept in the operative position. As a result, the engagement member 25 is raised up and its engagement piece 26 comes in engagement with the bent piece 34*a* of the stopper member 34, as represented by phantom lines in FIG. 2. This causes the printing ribbon 50 on the holder 13 to be raised up from the inoperative position as represented by real lines in FIG. 2 to the printing position as represented by phantom lines in the same drawing whereby a printing operation is ready to start. After completion of a single printing operation the step motor 5 is rotated in the reverse direction and thereby the ribbon lifting cam 17 is caused to rotate in the direction opposite to that as identified by an arrow mark L in FIGS. 1, 4(A) and 4(B). As a result, the first cam follower 30 resumes its home position and the holder 13 is turned back in the clockwise direction as seen in FIG. 1 against the resilient force of the tension spring 14 until the printing ribbon 50 resumes the inoperative position.

When continuous printing operation is to be performed, the ribbon lifting cam 17 is rotated further by a predetermined angle of $\theta 3$ in the direction as identified by an arrow mark L in FIGS. 1, 4(A) and 4(B) from the operative state where the printing ribbon 50 assumes the printing position for single printing operation (the operative state where it is rotated by a predetermined angle of $\theta 1$). At this moment the engagement piece 26 of the engagement member 25 is operatively engaged to the bent piece 34*a* of the stopper member 34, resulting in the first cam follower 30 from being inhibited from parting away from the support shaft 16 beyond a predetermined distance. Thus, the first cam follower 30 is introduced into the relieving section 20 from the end part of the first cam section 18 to carry out relative movement on the track T3, whereas the second cam follower 35 carries out relative movement on the track T4 in the third cam section 38 in the same manner as in the case of a single printing operation.

Next, when a corrective printing operation is to be carried out, the ribbon lifting cam 17 is rotated by a predetermined angle of $\theta 4$ in the direction opposite to that as identified by an arrow mark L in FIGS. 1, 4(A) and 4(B) from the operative state where the first cam follower 30 assumes its home position. This causes the second cam follower 35 to be introduced into the fourth cam section 39 from the home position in the third cam section 38 by carrying out relative movement on the track T5 in the first introduction section 40. As a result, the stopper member 34 is turned in the clockwise direction as seen in FIG. 2 to reach the inoperative position. This means that the first cam follower 30 assumes the operative state where it can move freely in the radial direction relative to the support shaft 16 which is a center of rotation of the ribbon lifting cam 17, because the engagement piece 26 of the engagement member 25 is disengaged from the bent piece 34*a* of the stopper member 34. Due to the fact that the stopper member 34 made of a plate spring normally urges the second cam follower 35 toward the cam face and the fourth cam section 39 has a cam groove of which depth is designed more than that of the first introduction section 40 while the first stepped section 40*a* is interposed therebetween, the second cam follower 35 can not return to the third cam section 38 but it carries out relative movement on the track T6 along the fourth cam section 39, after the first cam follower 30 resumes its home position. When the ribbon lifting cam 17 is rotated by a predetermined angle of $\theta 4+\theta 2$ in the direction as identified by an arrow mark L in FIGS. 1, 4(A) and 4(B) from the above-mentioned state, the first cam follower 30 which is forcibly urged outwardly under the effect of resilient force of the tension spring 14 carries out further relative movement on the track T1 in the first cam section 18 and thereafter it does so on the track T2 in the second cam section 19. During relative movement as mentioned above the second cam follower 35 carries out relative movement on the track T6 along the fourth cam section 39. As a result, the holder 13 is caused to turn about the support shaft 12 from the operative state as shown in FIG. 2 whereby the correction tape 60 assumes the printing position as shown in FIG. 6. After completion of a corrective printing operation the ribbon lifting cam 17 is rotated in the direction as identified by an arrow mark L in FIGS. 1, 4(A) and 4(B), whereas the first cam follower 30 returns to its home position from the second cam section 19 via the first cam section 18. As a result, the holder 13 is caused to turn about the support shaft 12 in the anticlockwise direction from the operative state as shown in FIG. 6 whereby the correction tape 60 resumes the inoperative position. In the meanwhile, the second cam follower 35 is displaced to its home position in the third cam section 38 from the fourth cam section 39 via the second introduction section 41 beyond the second stepped section 38*a*, resulting in the stopper member 34 assuming the operative position as mentioned above.

Next, operation of the ribbon lifting mechanism constructed in accordance with the first embodiment of the invention will be described below.

FIG. 2 shows the operative state where the second cam follower 35 is located at its home position in the third cam section 38 of the stopper cam 37 and thereby the stopper member 34 assumes the operative position. While the above-mentioned state is maintained, the first cam follower 30 is located also at its home position in the first cam section 18 of the ribbon lifting cam 17 as shown in FIG. 1. As long as the first cam follower 30 is held at its home position, the holder 13 maintains the substantially horizontal posture against the resilient force of the tension spring 14 and thereby both the printing ribbon 50 and the correction tape 60 assume their lower inoperative position.

When a predetermined letter key 6 is depressed by an operator while the above-mentioned state is maintained, the step motor 5 is rotated in the normal direction by a predetermined angle whereby the ribbon lifting cam 17 is caused to rotate in the direction as identified by an arrow mark L in FIGS. 1, 4(A) and 4(B) by a predetermined angle of $\theta 1$. At this moment the second cam follower 35 moves on the track T4 along the third cam section 38 of the stopper cam 37 and thereby the stopper member 34 is kept in the operative position. On the other hand, the first cam follower 30 moves on the track T1 in conformance with the contour of the first cam section 18. Thus, the first cam follower 30 is displaced away from the support shaft 16 and both the holder 13 and the engagement member 25 are turned about the support shaft 12 in the clockwise direction as seen in FIG. 2 by an angle corresponding to the extent of displacement as mentioned above with the aid of the resilient force of the tension spring 14, resulting in the engagement piece 26 of the engagement member 25 coming in engagement with the bent piece 34*a* of the stopper member 34, as shown by phantom lines in the drawing. As long as the engagement piece 26 is kept in engagement with the bent piece 34*a*, the printing ribbon 50 on the holder 13 is located opposite to the fore part of the platen 11 whereby a printing operation is ready to start. When a printing hammer 7 is depressed while the above-mentioned operative state is maintained, a required letter is printed on a sheet of printing paper 8 on the platen 11.

If a next letter key 6 is not depressed until a predetermined period of time elapses, the step motor 5 is rotated in the reverse direction and thereby the ribbon lifting cam 17 is rotated by a predetermined angle of $\theta 1$ in the direction opposite to that in FIGS. 1, 4(A) and 4(B). Namely, both the first cam follower 30 and the second cam follower 35 resume their home position. This means that the holder 13 is turned back to the position as shown in FIGS. 1 and 2 against the resilient force of the tension spring 14 so that the printing ribbon 50 assumes the inoperative position. Thus, a single printing operation is completed.

Next, when a next letter key 6 is depressed by an operator subsequent to a printing operation with the use of the preceding letter key 6 before a predetermined period of time elapses, the step motor 5 rotates the ribbon lifting cam 17 by a predetermined angle of $\theta 3$ at every time when the depressing operation is performed successively. This causes the second cam follower 35 to carry out relative movement on the track T4. During relative movement as mentioned above the stopper member 34 is held in the operative position and the engagement member 25 is operatively engaged with the stopper member 34. On the other hand, the first cam follower 30 carries out relative movement from the first cam section 18 on the track T3 which extends back to the position located in the proximity of the end of the first cam section 18 via the relieving section 20, the inclined section 21 and the shallow groove section 22.

If a next letter key 6 is not depressed by an operator within a predetermined period of time after completion of successive printing operations, the step motor 5 is rotated in the reverse direction and thereby the ribbon lifting cam 17 is rotated in the direction opposite to that as identified by an arrow mark L in the drawings in response to the function of a reference position detecting sensor 52 comprising an encoder 54 and other elements which are not shown, until the first cam follower 30 reaches its home position as shown in FIGS. 4(A) and 4(B). Thus, the printing ribbon 50 is lowered to the inoperative position in the same manner as in the case where a single printing operation is completed.

On the other hand, if incorrect printing is efrected, a back space key 6*a* is depressed so that the carriage 3 is returned to the incorrect printing position. Thereafter, the step motor 5 is rotated by a predetermined angle in the reverse direction by depressing a correction key 6*b* whereby the ribbon lifting cam 17 is rotated by a predetermined angle of $\theta 4$ in the direction opposite to that as identified by an arrow mark L in FIGS. 1, 4(A) and 4(B). This causes the second cam follower 35 to carry out relative movement on the track T5 and thereby it is introduced into the fourth cam section 39 from the third cam section 38 via the first introduction section 40. Since the fourth cam section 39 is designed to have a cam diameter larger than that of the third cam section 38, the stopper member 34 is caused to turn about the pivotal shaft 36 in the clockwise direction as seen in FIG. 2 until the inoperative position is reached. As long as the stopper member 34 is held at the inoperative position, its bent piece 34*a* is displaced away from the engagement piece 26 of the engagement member 25 without any occurrence of engagement therebetween.

While the above-mentioned operative state is maintained, the stopper member 34 is kept in the inoperative position, because the second cam follower 35 carries out relative movement on the track T6 of the fourth cam section 39 even when the ribbon lifting cam 17 is rotated in the direction as identified by an arrow mark L in FIGS. 1, 4(A) and 4(B). Thus, the first cam follower 30 which has moved along the first cam section 18 is ready to move to the second cam section 19 under the effect of the resilient force of the tension spring 14 without any occurrence of such a malfunction that it is inhibited from moving to the relieving section 20 from the end part of the first cam section 18. Thereafter, when a letter key 6 is depressed to correct the incorrectly printed letter, the ribbon lifting cam 17 is rotated by a predetermined angle of $\theta 4+\theta 2$ whereby the first cam follower 30 is caused to move on the tracks T1 and T2. As a result, the holder 13 is turned about the pivotal shaft 12 to the position as shown in FIG. 6 with the aid of the resilient force of the tension spring 14 and the correction tape 60 is located at the printing position. Then, the incorrectly printed letter can be erased by operating a printing hammer 7.

On completion of the erasing operation the step motor 5 is rotated in the reverse direction and thereby the ribbon lifting cam 17 is rotated by a predetermined angle of $\theta 2$ in the direction opposite to that as identified by an arrow mark L in FIGS. 1, 4(A) and 4(B), resulting in the first cam follower 30 returning to its home position. Thus, the holder 13 is turned in the anticlockwise direction as seen in FIG. 6 against resilient force of the tension spring 14 owing to the cam function of the second cam section 19 and the first cam section 18 whereby the correction tape 60 assume the inoperative position as shown in FIG. 1. On the other hand, when the second cam follower 35 is returned by a predetermined angle of $\theta 2$ in the direction opposite to that as identified by an arrow mark L in FIG. 5(B), it is displaced to the third cam section 38 from the fourth cam section 39 via the second introduction section 41. As a result, the stopper member 34 is caused to turn about the pivotal shaft 36 in the anticlockwise direction from the position as shown in FIG. 6 and thereby it is returned to the position as shown in FIG. 2, that is, the operative position.

Next, description will be made below as to the ribbon lifting mechanism in accordance with the second embodiment of the invention with reference to FIGS. 7 to 10.

As will be apparent from the drawings, the platen 11, the holder 13, the tension spring 14, the ribbon cartridge 15, support shaft 16, the engagement member 25 and the first cam follower 30 are designed and constructed in the same manner as those in the first embodiment and therefore their description will not be repeated.

The ribbon lifting cam 17*a* is formed with a first cam section 18, a second cam section 19, a relieving section 20, an inclined section 21 and a shallow groove section 22 on the one side surface thereof in the same manner as in the first embodiment and a first cam follower 30 is located opposite to the above-mentioned sections.

Figure 9:
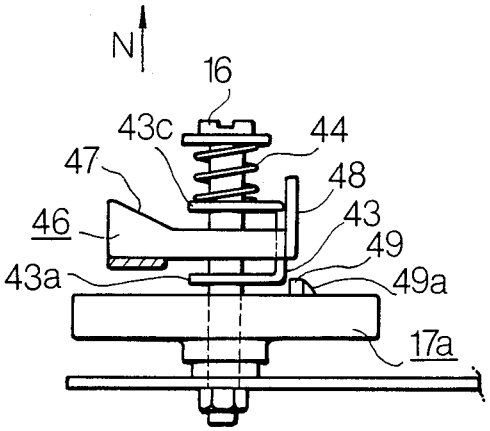
Figure 10:
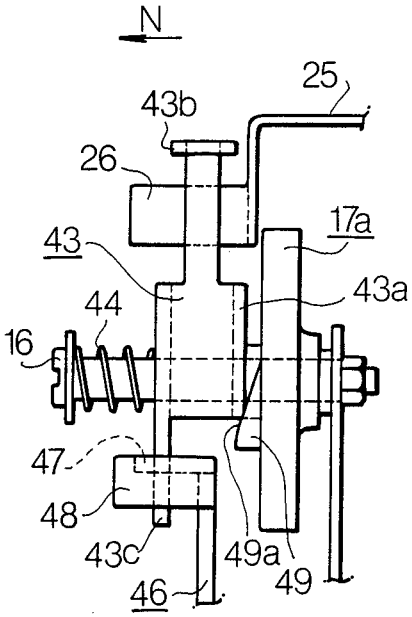

The ribbon lifting cam 17*a* is rotatably mounted on the support shaft 16 and a stopper member 43 is turnably supported also on the support shaft 16 with the aid of its U-shaped portion 43*a* by the side of the ribbon lifting cam 17*a*. Further, as shown in FIGS. 9 and 10, the stopper member 43 is adapted to slide on the support shaft 16 in the axial direction. Further, it is normally urged toward the ribbon lifting cam 17*a* under the effect of the resilient force of a compression spring 44 which is mounted on the support shaft 16. The stopper member 43 is formed with a bent piece 43*b* at the one extreme end thereof which is adapted to come in engagement with an engagement piece 26 of the engagement member 25. The stopper member 43 includes an extension 43*c* on the opposite side to the engagement piece 26 and a tension spring 45 adapted to normally turn the stopper member 43 in the anticlockwise direction as seen in FIG. 7 is attached to the extension 43*c*.

Figure 7:
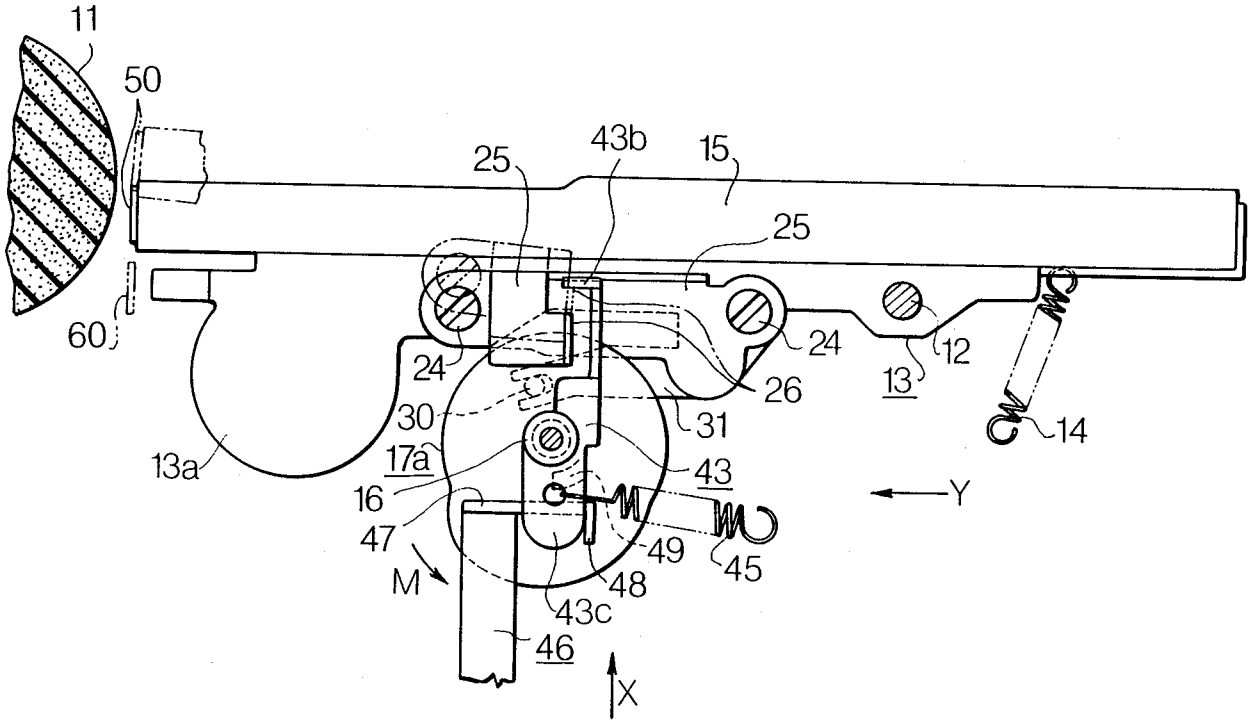
FIGS. 7 to 10 show a ribbon lifting mechanism in accordance with the second embodiment of the invention.

Further, a limiting member 46 for limiting an extent of turning movement of the stopper member 43 in both the clockwise and anticlockwise directions as seen in FIG. 7 is fixedly secured to the carriage 3. The limiting member 46 includes an inclined piece 47 for displacing the stopper member 43 in the direction as identified by an arrow mark N in FIGS. 9 and 10 against the resilient force of the spring 44 by way of engagement with the extension 43*c* of the stopper member 43 and an engagement piece 48 for inhibiting further turning movement of the stopper member 43 in the direction as identified by an arrow mark M from the position as shown in FIG. 7 at the fore end thereof.

Figure 8:
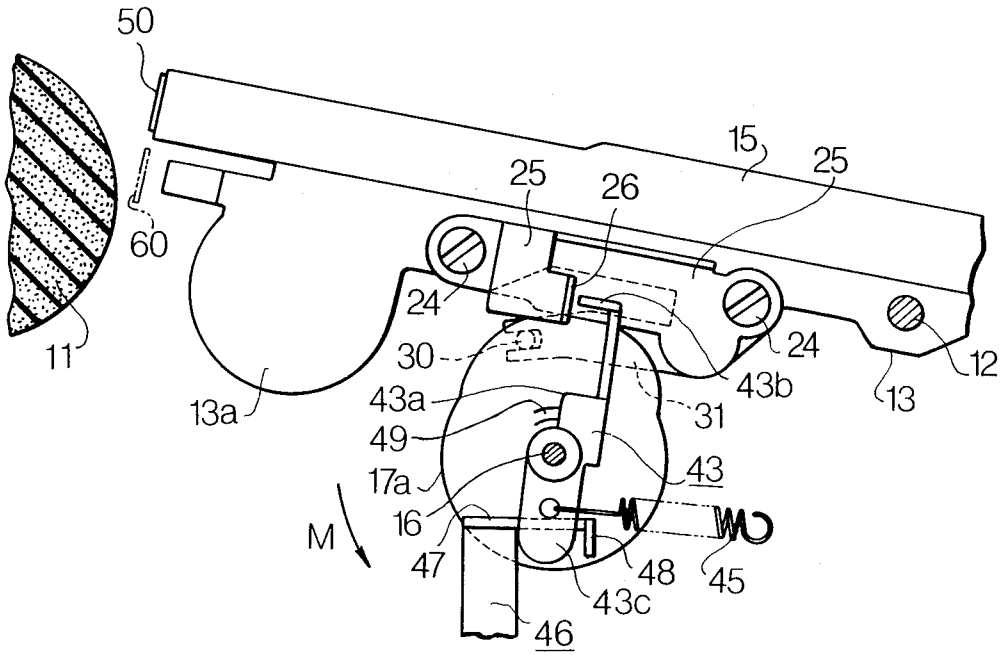

The ribbon lifting cam 17*a* is integrally formed with a projection 49 on the opposite side surface to that on which the first cam section 18 and other cam sections are provided and the projection 49 is projected toward the stopper member 43. As shown in FIGS. 8, 9 and 10, the projection 49 is located away from the support shaft 16 by a predetermined distance and has the arched configuration. As will be best seen in FIG. 10, the projection 49 has an inclined face 49*a* of which height linearly increases from the one end to the other one of the arched configuration. The height of the inclined face 49*a* is so determined that it abuts against the U-shaped portion 43*a* of the stopper member 43 at the position located midway of the inclined face 49*a*. Orientation of the inclined face 49*a* is determined such that the one end of the U-shaped portion 43*a* of the stopper member 43 comes in abutment against the inclined face 49*a* when the ribbon lifting cam 17*a* is rotated in the direction as identified by an arrow mark M by a predetermined angle.

Next, operation of the ribbon lifting mechanism in accordance with the second embodiment of the invention will be described below.

FIG. 7 shows the inoperative state of the ribbon lifting mechanism. As will be apparent from the drawing, the stopper member 43 is brought in engagement with the engagement piece 48 of the limiting member 46 under the effect of the resilient force of the tension spring 14. While the above-mentioned state is maintained, the bent piece 43*b* of the stopper member 43 assumes the position where it is operatively engaged with the engagement piece 26 of the engagement member 25 when the latter is raised up, that is, the operative position where the printing ribbon 50 is ready to be in use for a printing operation. Further, while the above-mentioned state is maintained, the first cam follower 30 assumes its home position as shown in FIG. 4(A) and the holder 13 is maintained in the horizontal posture against the resilient force of the tension spring 14 whereby both the printing ribbon 50 and the correction tape 60 are located in their lower inoperative position.

When a predetermined letter key 6 is depressed to perform a printing operation, the step motor 5 is rotated in the normal direction by a predetermined angle in the same manner as in the first embodiment and thereby the ribbon lifting cam 17*a* is rotated in the direction as identified by an arrow mark M in FIG. 7 by a predetermined angle of $\theta 1$. During the rotating operation as mentioned above the first cam follower 30 is caused to move along the contour of the first cam section 18 so that both the holder 13 and the engagement member 25 are turned about the pivotal shaft 12 in the clockwise direction as seen in FIG. 7 under the effect of the resilient force of the tension spring 14. At this moment the U-shaped portion 43*a* of the stopper member 43 abuts against the inclined face 49*a* of the projection 49 on the ribbon lifting cam 17*a* and then it carries out relative movement in such a direction that the height of the inclined face 49*a* increases. As long as the stopper member 43 comes in contact with the inclined face 49*a*, it moves in the direction as identified by an arrow mark N in FIG. 10 while it is held at the position as shown in FIG. 7, that is, the operative position. Thereafter, as the ribbon lifting cam 17*a* is rotated in the direction as identified by an arrow mark M in the drawings by a predetermined angle which is determined for a printing operation, the engagement piece 26 of the engagement member 25 is brought in engagement with the bent piece 43*b* of the stopper member 43 and thereby the printing ribbon 50 on the holder 13 is raised up to the printing position as represented by phantom lines in FIG. 7 which is located opposite to the fore part of the platen 11. Thus, printing operation is ready to start.

If a next letter key 6 is not depressed by an operator before a predetermined period of time elapses, the step motor 5 is rotated in the reverse direction in the same manner as in the first embodiment and thereby the ribbon lifting cam 17*a* is rotated in the direction opposite to that as identified by an arrow mark M in FIG. 7. This causes the holder 13 to be turned about the pivotal shaft 12 in the anticlockwise direction with the aid of a cam function whereby the printing ribbon 50 is returned to the lower inoperative position as shown by real lines in FIG. 7. At this moment the position where the stopper member 43 is engaged with the projection 49 is displaced from the higher area of the inclined face 49*a* to the lower one and thereafter the stopper member 43 is disengaged from the projection 49. During displacement of the stopper member 43 in that way it moves in the direction opposite to that as identified by an arrow mark N in FIG. 10 while it slides down along the inclined face 49*a* under the effect of the resilient force of the compression spring 44.

On the other hand, when a next letter key 6 is depressed subsequent to a printing operation of the preceding letter key 6 before a predetermined period of time elapses, the ribbon lifting cam 17 is successively rotated by a predetermined angle in the direction as identified by an arrow mark M in FIG. 7. Thus, a printing operation can be performed continuously. It should be noted that during a continuous printing operation the stopper member 34 moves only in the direction as identified by an arrow mark N in FIGS. 9 and 10 as well as in the opposite direction to the foregoing one without any occurrence of displacement from the operative position as shown in FIG. 7 and the holder 13 is held at the operative state where the printing ribbon 50 is located at the printing position.

If an incorrect printing operation is performed, the carriage 3 is caused to resume the incorrect printing position by depressing operation of the back space key 6*a*. Then, a correction key 6*b* is depressed and thereby the ribbon lifting cam 17 is rotated by means of the step motor 5 in the normal direction until the projection 49 goes over the stopper member 43, that is, in the direction as identified by an arrow mark M in FIG. 7. Immediately after completion of rotation in the normal direction the ribbon lifting cam 17*a* is rotated by a predetermined angle in the reverse direction, that is, in the direction opposite to that as identified by an arrow mark M in the same drawing. As shown in FIG. 8, this allows the projection 49 to come in abutment against the U-shaped portion 43*a* of the stopper member 43. Thus, the stopper member 43 is turned in the clockwise as seen in the drawing in dependence on rotation of the ribbon lifting cam 17*a* in the direction opposite to that as identified by an arrow mark M, resulting in the bent piece 43*b* of the stopper member 43 being disengaged from the engagement piece 26 of the engagement member 25. Once disengagement is achieved in that way, the holder 13 is turned about the pivotal shaft 12 in the clockwise direction as seen in the drawing under the effect of the resilient force of the tension spring 14. At this moment the first cam follower 30 is located at the relieving section 20 and when the stopper member 43 is disengaged from the engagement member 25, the holder 13 is caused to turn until the first cam follower 30 is displaced from the relieving section 20 to the second cam section 19. As a result, the correction tape 60 is displaced to the printing position as shown in FIG. 8 and the incorrectly printed letter can be erased by actuating the printing head 7*a*.

After completion of the erasing operation as mentioned above the ribbon lifting cam 17*a* is rotated further in the direction to that as identified by an arrow mark M in FIG. 7. This causes the extension 43*c* of the stopper member 43 to come in abutment against the inclined face 47 of the limiting member 46 and thereafter it slides upwardly along the inclined face 47 as the ribbon lifting cam 17*a* is rotated further. Thus, as is apparent from FIGS. 9 and 10, the whole stopper member 43 is displaced in the direction as identified by an arrow mark N in the drawings by means of the inclined face 47 of the limiting member 46. The projection 49 is later disengaged from the U-shaped portion 43*a* of the stopper member 43, resulting in the stopper member 43 resuming the operative position as shown in FIG. 7 under the effect of the resilient force of the. tension spring 45.

On the other hand, since the first cam follower 30 is displaced to the first cam section 18 from the second cam section 19 as the ribbon lifting cam 17*a* is rotated, the holder 13 is turned backwardly in the anticlockwise direction as seen in FIG. 8 against the resilient force of the tension spring 14 until its lower inoperative position as shown in FIG. 7 is reached.

As will be readily understood from the above description, the ribbon lifting mechanism of the invention is so constructed that either of the printing ribbon 50 and the correction tape 60 selectively assumes the printing position by mechanically rotating the ribbon lifting cam 17 or 17*a* adapted to turn the holder 13 without any necessity for special actuating means such as electromagnet or the like which are employed for the conventional ribbon lifting mechanism. Thus, advantageous features of the ribbon lifting mechanism of the invention are that it is simple in structure and can be fabricated at an inexpensive cost.

While the present invention has been described above only with respect to two preferred embodiments, it should of course be understood that it should not be limited only to them but various changes or modifications may be made in any acceptable manner without departure from the spirit and scope of the invention as defined by the appended claims.

What is claimed is:

1. A ribbon lifting mechanism for a typewriter comprising:

a frame;

a holder supported rotatably on said frame, for holding a printing ribbon and a correction tape;

a first means for normally urging said holder toward a predetermined direction;

a ribbon lifting cam having a plurality of cam sections formed threon, said cam sections allowing the holder to turn so as to selectively assume an operative state where the printing ribbon is located at a printing position, an operative state where the correction tape is located at said printing position and an inoperative state where both the printing ribbon and the correction tape are located out of the printing position;

a first cam follower connected to said holder for being controlled by said cam sections;

driving means for rotating the ribbon lifting cam in both normal and reverse directions in response to actuation of a key such as a letter key or the like;

a movable stopper member engageable with and disengageable from the holder, said stopper member and a means for restricting an extent of turning movement serving to restrict an extent of turning movement of the holder within a predetermined range of movement when said stopper member is engaged with the holder; and means for displacing the stopper member to selectively assume the engagement position where the stopper member is engaged with the holder and the disengagement position where the stopper member is disengaged from the holder when the ribbon lifting cam is rotated; wherein the means for displacing the stopper member comprises:

a second cam follower disposed on the stopper member; and a groove-shaped stopper cam section for engaging said second cam follower, said stopper cam section being rotatable in both the normal and reverse directions, and the stopper cam section including an annular second cam section for guiding relative movement of the second cam follower during a printing operation as well as during a non-printing operation, an arch-shaped third cam section designed coaxial relative to said second cam section to guide relative movement of the second cam follower when a corrective printing operation is performed and two introduction cam grooves by way of which said second cam section is connected with said third cam section to guide relative movement of the second cam follower during corrective printing operation.

2. A ribbon lifting mechanism as defined in claim 1, wherein the stopper member is provided with a second urging member which serves to urge the stopper member in order to assure that the foremost end of the second cam follower comes in abutment against the bottom of the cam groove on the stopper cam section and wherein stepped portions are formed between the second cam section and the two introduction cam grooves in order to assure that the second cam follower moves from the second cam section to the third cam section via one of said two introduction cam grooves and then the second cam follower returns to the second cam section via the other of said two introduction cam grooves during corrective printing operation.

3. A ribbon lifting mechanism as defined in claim 2, wherein during a printing opeation the second cam follower moves in the second cam section by rotation of the ribbon lifting cam in the normal direction so as to allow the stopper member to be held at the engaged position, whereas during a corrective printing operation the second cam follower moves from the second cam section to the third cam section via said one introduction cam groove so as to allow the stopper member to be displaced to the disengaged position.

4. A ribbon lifting mechanism for a typewriter comprising:

a frame;

a holder supported rotatably on said frame for holding a printing ribbon and a correction tape;

a first means for normally urging said holder toward a predetermined direction;

a ribbon lifting cam having a plurality of cam sections formed thereon, said cam sections allowing the holder to turn so as to selectively assume an operative state where the printing ribbon is located at a printing position, an operative state where the correction tape is located at said printing position and an inoperative state where both the printing ribbon and the correction tape are located out of the printing position;

a first cam follower connected to said holder and controlled by said cam sections;

driving means for rotating the ribbon lifting cam in both normal and reverse directions in response to actuation of a key such as a letter key or the like;

a movable stoper member engageable with and disengageable from the holder, said stopper member and a means for restricting an extent of turning movement serving to restrict an extent of turning movement of the holder within a predetermined range of movement when said stopper member is engaged with the holder; and means for displacing the stopper member to selectively assume the engagement position where the stopper member is engaged with the holder and the disengagement position where the stopper is disengaged from the holder when the ribbon lifting cam is rotated; the means for displacing the stopper member comprising a support shaft for supporting the stopper member in such a manner as to turn thereabout and move in the axial direction, second urging means for normally turning the stopper member in a predetermined direction, a limiting member for limiting turning movement of the stopper member within a predetermined extent of turning movement, third urging means for thrusting the stopper member toward the ribbon lifting cam in the axial direction of the support shaft and a projection disposed on the ribbon lifting cam to come in engagement with the stopper member.

5. A ribbon lifting mechanism as defined in claim 4, wherein said projection includes an inclined face for contacting the stopper member in such a meanner that the stopper member moves past said projection during rotation of the ribbon lifting cam in the normal direction and an engagement face with which the stopper member is engaged when the ribbon lifting cam is rotated in the reverse direction.

6. A ribbon lifting mechanism as defined in claim 4, wherein said means for restricting an extent of turning movement includes a stopper for inhibiting the stopper member from rotating in one direction and an inclined member for allowing the projection to be disengaged from the stopper member by coming in contact with the stopper member during rotation thereof in the reverse direction and then displacing the stopper member in such a direction that the stopper member is disengaged from the ribbon lifting cam.

7. A ribbon lifting mechanism for a typewriter essentially comprising;

a frame;

a holder supported rotatably on said frame for holding a printinq ribbon and a correction tape and serving to allow said printing ribbon and said correction tape to selectively assume a printing position;

a first means for normally urging said holder toward the printing position;

a ribbon lifting cam having a plurality of cam sections formed on the one face thereof, said cam sections comprising a first cam section for allowing the printing ribbon to assume the printing position by turning movement of the holder, a second cam section formed in continuation from said first cam section so as to allow the correction tape to assume the printing position and a relieving section formed in continuation from the first cam section, said relieving section extending in parallel with said second cam section;

driving means for rotating the ribbon lifting cam in both normal and reverse direction;

a single cam follower connected to the holder to be moved by following the relative rotational movement of the ribbon lifting cam;

a stopper member for holding the holder so as to allow the printing ribbon to be located at the printing position by introducing into the relieving section the cam follower which is actuated in accordance with the first cam section by rotation of the ribbon lifting cam in the normal direction during normal printing operation, and a second cam follower disposed on the stopper member and a groove-shaped means for displacing said stopper member for engaging said second cam follower, said displacing means being disposing on th eother face of the ribbon lifting cam in order to assure that the stopper member is released from the holding state of the holder during a corrective print operation so that the single cam follower which is actuated in accordance with the first cam section is caused to move in accordance with the second cam section and thereby the correction tape is located at the printing position and said stopper member including an annular third cam section for guiding relative movement of the second cam follower during printing operation as well as during nonprinting operation, a arch-shaped fourth cam section formed co-axial relative to said third cam section to guide relative movement of the second cam follower during a corrective printing operation and two introduction cam grooves for establishing a connection between the third and fourth cam sections to guide relative movement of the second cam follower during a corrective printing operation.

8. A ribbon lifting mechanism as defined in claim 7, wherein the stopper member is provided with a second urging member which serves to urge the stopper member in order to assure that the foremost end of the second cam follower engages said groove-shaped means and wherein stepped sections are formed between the third cam section and the two introduction cam groove as well as between the fourth cam section and the two introduction cam grooves in order to assure that the second cam follower moves from the third cam section to the fourth cam section via one of said two introduction cam grooves and then the second cam follower returns to the third cam section via the other of said two introduction cam grooves during a corrective printing operation.

9. A ribbon lifting mechanism as defined in claim 7, wherein when a corrective print operation is performed, the stopper member is first displaced to a position where the holder can not maintain the existing state by rotating the ribbon lifting cam by a predetermined angle in the reverse direction and thereafter the single cam follower which is actuated in accordance with the first cam section is caused to move in accordance with the second cam section by rotating the ribbon lifting cam in the normal direction so that the holder is displaced without any occurrence of engagement with the stopper member until the correction tape is located at the printed position.

10. A ribbon lifting mechanism for a typewriter essentially comprising;

a frame;

a holder supported rotatably on said frame, for holding a printing ribbon and a correction tape and serving to allow said printing ribbon and said correction tape to selectively assume a printing position;

a first means for normally urging said holder toward the printing position;

a ribbon lifting cam having a plurality of cam sections formed on the one face thereof, said plurality of cam sections comprising a first cam section for allowing the printing ribbon to assume the printing position by turning movement of the holder, a second cam section formed in continuation from said first cam section so as to allow the correction tape to assume the printing position and a relieving section formed in continuation from the first cam section, said relieving section extending in parallel with said second cam section;

driving means for rotating the ribbon lifting cam in both a normal and a reverse direction;

a single cam follower connected to the holder to be moved by following the relative rotational movement of the ribbon lifting cam;

a stopper member for holding the holder so as to allow the printing ribbon to be located at the printing position by introducing into the relieving section the single cam follower which is actuated in accordance with the first section by rotation of the ribbon lifing cam in the normal direction during normal printing operation; and means for displacing said stopper member, said displacing means being disposed on the other face of the ribbon lifting cam in order to assure that the stopper member is released from the holding state of the holder during a corrective printing operation by introducing the cam follower into the relieving section by rotation of the ribbon lifting cam in the normal direction in the same manner as during the normal printing operation and thereafter rotating the ribbon lifting cam in the reverse direction by a predetermined angle, said means for displacing the stopper member comprising a support shaft for supporting the stopper member in such a manner as to turn thereabout and move in the axial direction, second urging means for normally turning the stopper memeber in a predetermined direction, a limiting member for limiting turning movement of the stopper member within a predetermined extent of turing movement, third urging means for thrusting the stopper member toward the ribbon lifting cam in the axial direction of the support shaft and a projection disposed on the ribbon lifting cam to come into engagement with the stopper memeber.

11. A ribbon lifting mechanism as defined in claim 10, wherein the single cam follower is introduced into the relieving section of the ribbon lifting cam by rotation of the ribbon lifting cam in the normal direction before actuating the means for displacing the stopper member.

12. A ribbon lifting mechanism as defined in claim 10, wherein said projection includes an inclined face for coming in contact with the stopper member in such a manner that the stopper member moves past said projection during rotation of the ribbon lifting cam in the normal direction and an engagement face with which the stopper member is engaged when the ribbon lifting cam is rotated in the reverse direction.

13. A ribbon lifting mechanism as defined in claim 10, wherein said limiting member includes a stopper for inhibiting the stopper member from rotating in one direction and an inclined member for allowing the projection to be disengaged from the stopper member by coming in contact with the stopper member during rotation thereof in the reverse direction and then displacing the stopper member in such a direction that the stopper member is disengaged from the ribbon lifting cam.

* * * * *

UNITED STATES PATENT AND TRADEMARK OFFICE

CERTIFICATE OF CORRECTION

PATENT NO. : 4,728,208

DATED : March 1, 1988

INVENTOR(S) : Takayuki IWASE et al

It is certified that error appears in the above-identified patent and that said Letters Patent is hereby corrected as shown below:

Col. 4, line 1, "accomcdated" should read --accommodated--.

Col. 7, line 66, before "resilient" insert --the--.

Col. 9, line 45, "efrected" should read --effected--.

Col. 10, line 28, before "resilient" insert --the--;

line 31, "assume" should read --assumes--.

Col. 13, line 43, "the." should read --the--;

line 56, "mcchanically" should read --mechanically--.

Col. 16, line 13, "printinq" should read --printing--.

Signed and Sealed this

Sixteenth Day of August, 1988

*Attest:*

*Attesting Officer*

DONALD J. QUIGG

*Commissioner of Patents and Trademarks*